US009539712B2

(12) United States Patent
Neto

(10) Patent No.: US 9,539,712 B2
(45) Date of Patent: Jan. 10, 2017

(54) TOOL KIT FOR REMOVAL OF BROKEN SPARK PLUGS

(71) Applicant: Lisle Corporation, Clarinda, IA (US)

(72) Inventor: Luiz Correa Neto, Framingham, MA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 14/838,063

(22) Filed: Aug. 27, 2015

(65) Prior Publication Data

US 2016/0067853 A1 Mar. 10, 2016

Related U.S. Application Data

(60) Provisional application No. 62/045,697, filed on Sep. 4, 2014.

(51) Int. Cl.

| | |
|---|---|
| ***B25B 27/18*** | (2006.01) |
| ***B25B 27/00*** | (2006.01) |
| *B25B 27/14* | (2006.01) |
| *B25B 23/10* | (2006.01) |

(52) U.S. Cl.

CPC ..... *B25B 27/18* (2013.01); *B25B 27/0035* (2013.01); *B25B 23/103* (2013.01); *B25B 27/143* (2013.01)

(58) Field of Classification Search

CPC .... B25B 27/18; B25B 27/0035; B25B 23/103; B25B 27/143; B25B 13/5075; B25B 13/48

USPC ..... 81/124.4, 53.2, 125, 447

See application file for complete search history.

(56) References Cited

U.S. PATENT DOCUMENTS

| | | | | |
|---|---|---|---|---|
| 728,096 | A * | 5/1903 | Giltner | B25C 11/00 254/20 |
| 2,547,986 | A * | 4/1951 | Van Dermark | B25B 13/483 138/109 |
| 2,589,935 | A * | 3/1952 | Guisti | B25B 13/483 81/125 |
| 3,529,497 | A * | 9/1970 | Brooks | B25B 27/02 173/91 |
| 5,802,692 | A * | 9/1998 | Philippe | B25B 27/0035 29/244 |
| 6,185,804 | B1 * | 2/2001 | Burns | B25B 13/48 29/264 |
| 6,584,662 | B1 * | 7/2003 | Krick | B25B 27/0035 29/244 |

(Continued)

OTHER PUBLICATIONS

Ford Motor Company Online Publication: "Spark Plug Removal Instructions—5.4 3V, TSB 06-15-2": Jul. 14, 2006.

(Continued)

*Primary Examiner* — Hadi Shakeri
*Assistant Examiner* — Danny Hong
(74) *Attorney, Agent, or Firm* — Banner & Witcoff, Ltd.

(57) ABSTRACT

A tool and kit for removal of a broken spark plug from a cylinder head may include first and/or second tools, and/or a supplemental tool. The first tool is designed to position a broken porcelain element into the spark plug tip so that a second tool may be utilized to engage the tip by threading into the tip and thereafter axially withdrawing the plug tip from the cylinder head into the hollow tubular member. The supplemental tool may be utilized to engage the plug wire contact of a plug with axially projecting, elastic cantilever segments and axially withdraw the attached plug contact into a hollow tubular member.

10 Claims, 10 Drawing Sheets

(56) References Cited

U.S. PATENT DOCUMENTS

| | | | | |
|---|---|---|---|---|
| 6,640,673 | B1 * | 11/2003 | Ploeger | B25B 5/147 29/263 |
| 7,814,814 | B2 * | 10/2010 | Whitehead | B25B 27/0035 29/426.1 |
| 7,987,572 | B2 * | 8/2011 | Badman | B25B 27/023 29/402.03 |
| 8,544,366 | B2 * | 10/2013 | Leyva | B25B 13/483 81/124.4 |
| 9,132,533 | B2 * | 9/2015 | Lesche | B25B 13/483 |
| 2013/0111750 | A1 * | 5/2013 | Lesche | B25B 13/483 29/888.01 |

OTHER PUBLICATIONS

Tom Dudycha: "Idea Disclosure Agreement relating to a tool for use on Ford Triton Three valve engines": Sep. 20, 2013.
Ron Bailey: "New Product Design relating to shorten the rod": Oct. 10, 2013.
Ed Falconer: "Idea Disclosure Agreement relating to broken spark plug remover kit 65600": Oct. 30, 2013.
Paul Kleinsasser: "Idea Disclosure Agreement relating to porcelain remover for Ford 5.4": Jun. 25, 2012.
John J. Griffin: "Idea Disclosure Agreement relating to broken spark plugs on 5.4 Fords": Apr. 28, 2013.
OTC Tool, LLC: "Ford Spark Plug Removal Tool Form No. 566825—OTC 6918": 2012.

* cited by examiner 109
102
100
106
108
112
120
114
104
116
118
110
122

104
100
106
109
102
114
122
118
112
108
116
110
120

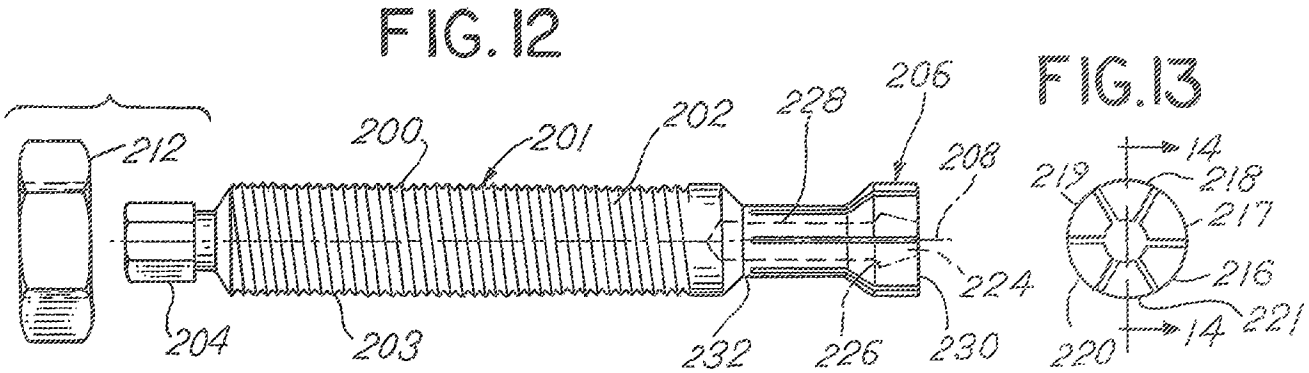
FIG. 12
FIG. 13
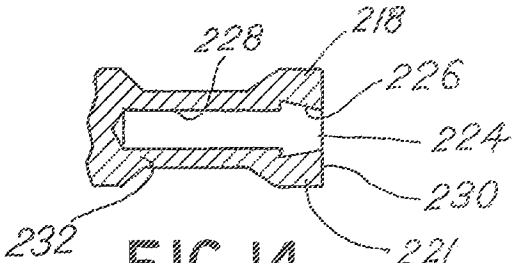
FIG. 14
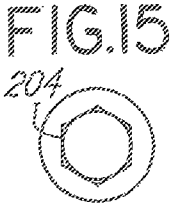
FIG. 15
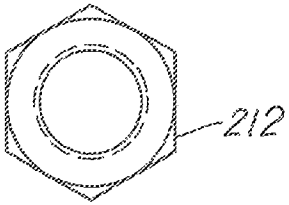
FIG. 16

TOOL KIT FOR REMOVAL OF BROKEN SPARK PLUGS

CROSS REFERENCE TO RELATED APPLICATION

This application is a utility application which claims priority to and the benefit of U.S. Provisional Patent Application Ser. No. 62/045,697 filed Sep. 4, 2014, entitled "Tool Kit for Removal of Broken Spark Plugs" which is incorporated by reference herein and made a part hereof.

BACKGROUND OF THE INVENTION

In a principal aspect the present invention relates to a tool and an associated kit of tools for removal of a broken spark plug from a cylinder head.

Motor vehicle internal combustion engines typically include spark plugs threaded into the engine cylinder head to provide an electric ignition spark for igniting combustible gasses within each cylinder. Each spark plug includes a distributor wire contact for attachment of a spark plug wire to a current source. The contact comprises the exposed end of a wire conductor axially extending through the plug leading to a spark gap at the tip of the plug inside the cylinder. Ignition of a fuel/air mixture in the cylinder is effected by a spark in the gap at the tip of the plug which projects through the cylinder head into the cylinder.

Spark plugs utilized for such an ignition system have a variety of constructions. Typically, a spark plug will include an axial conductor encased in a porcelain insulator. The conductor connects the outer end contact terminal of the plug to the spark gap tip. A threaded cylindrical body surrounds the insulator and supports and encases the component parts of the spark plug thereby enabling threaded insertion or removal of the plug from a threaded bore in the cylinder head of an internal combustion engine.

Spark plugs are typically periodically removed from the cylinder head to permit replacement. On occasion a plug will break during removal. Thus, the problem of removal from and replacement of spark plugs in a cylinder head is exacerbated by factors such as the design of the plug and the manner in which the plug is inserted into the cylinder head. This topic is described in Technical Service Bulletin #TSB 06-15-2 of the Ford Motor Company incorporated herewith by reference. The Service Bulletin discusses the problem associated with spark plug replacement and also suggests a solution to effect removal of a broken spark or damaged plug from the cylinder head of a motor vehicle engine.

An example of a tool used for removal of a broken spark plug from a cylinder head is described in an instruction memorandum for an OTC Product No. 6918 entitled "Ford Spark Plug Removal Tool" issued Oct. 17, 2012. The described spark plug removal tool employs the use of a collet for gripping the wire connector and porcelain body of a spark plug to effect removal from a cylinder head. The operating instructions and circular are incorporated herewith by reference.

Nonetheless, during attempted removal of a plug, the cylindrical spark plug tip may break and separate from the body of the threaded plug. As such, the tip remains positioned within the cylinder head and must be removed before a new plug can be threaded into the cylinder head.

Applicant's assignee developed tools to address various issues associated with the removal of a broken spark plug from the cylinder head of a motor vehicle, and, in particular, from the cylinder head of a vehicle of the type described in the Technical Service Bulletin referenced above, among others. Specifically, U.S. Pat. No. 7,814,814 entitled "Tool Kit for Removal of Broken Spark Plugs", incorporated herein by reference, discloses a tool for removal of a broken spark plug from a cylinder head wherein the spark plug tip is separated from the remainder of the plug.

The subject matter of U.S. Pat. No. 7,814,814 is marketed by applicant's assignee, Lisle Corporation, as Spark Plug Removal Kit Number 65600. The kit was developed to facilitate the removal of certain spark plug components of a broken plug from the cylinder head of an engine. That is, during a plug removal procedure, the spark plug may occasionally break leaving the firing tip element in the head whereas the remainder of the spark plug may be successfully removed from the cylinder head. In this circumstance the insulator tip of the spark plug, which is typically a porcelain material, is pushed into the firing tip element to allow a firing tip removal tool to engage the firing tip and effect removal.

However, in certain instances removal of the spark plug may result in breakage of plug parts of the plug other than the tip causing such parts to remain within the cylinder head. For example, the porcelain insulator at the upper end of the plug may remain intact or partially intact within the cylinder head. When this occurs, the outer annular body of the plug may remain within the cylinder head along with various other components associated with the spark plug. The annular body may be removed by unthreading it from the head. However, the porcelain insulator may remain within the cylinder head along with other parts of the spark plug. Thus, the porcelain insulator must be removed from the cylinder head before a firing tip 38 can be removed using the tool such as described in U.S. Pat. No. 7,814,814. However, gripping the wire contact or wire connector which may remain lodged in the cylinder head is difficult and is compounded by the problem of removing the porcelain insulator. Needle nose pliers is often used by a mechanic to attempt to effect removal of the porcelain insulator. Again, this is a difficult operation to perform and may result in breakage of the component parts thus rendering the situation much more complex.

SUMMARY OF THE INVENTION

Briefly, the present invention comprises a supplemental tool for removal of a wire connector of a broken spark plug from a cylinder head. The invention further comprises, as an embodiment or feature of the invention, ancillary tools such as those generally described in U.S. Pat. No. 7,814,814 in a kit in combination with the supplemental tool of the invention. The kit may thus include a first tool designed to position a broken porcelain insert of a broken spark plug within the tubular, metal, spark plug tip of the broken spark plug located in the cylinder head of a motor vehicle. Further, a second tool may comprise an annular body member designed to be cooperative in combination with the first tool and the supplemental tool of the invention.

That is, when attempting to remove a spark plug from a cylinder head the threaded body of the spark plug may be removed from the cylinder head by unscrewing the body of the plug. During the unscrewing and removal operation, the spark plug may break into two parts: (1) the threaded body which is removed, and (2) the broken tubular tip and porcelain insert retained in the tubular tip which both remain in the cylinder head. A portion of the porcelain insert or element of the plug and the tubular conductive spark tip of the spark plug thus remain within the cylinder head.

A first tool in the kit is thus designed to be threaded into the spark plug socket in the cylinder head and a pusher rod 64 threaded in a tube 62 is then manipulated to push the porcelain element into the annular, cylindrical tip (see FIGS. 4 and 5). The first tool is comprised of a hollow, tubular member 62 with an elongate, central rod 64 threadably inserted therein. A pin 82 projects from one end of the rod 64. The pin 82 is sized and configured to enable engagement with the porcelain element in the tubular tip of the spark plug and upon axial movement of the rod 64, drive the porcelain element into the tubular tip of the plug residing in the cylinder head. Upon positioning the porcelain element within the tubular tip, the first tool (tube 62 and rod 64) is removed or unthreaded from the cylinder head, and the second tool is positioned in axial alignment with the spark plug tip residing in the spark plug opening or socket in the cylinder head.

The second tool is comprised of a hollow cylindrical body member 100 with an elongate, center axial rod 110 that is tapered and threaded at the leading end whereby the cylindrical tip of the rod 110 may be axially screwed directly while forming threads in the hollow tubular tip 38 to thereby attach to and grip the tip 38. The second tool rod 110 further includes a thread pattern at its outer drive end that enables the attachment of a nut 118 at the outer end of the rod 110 which can be turned to effect reverse axial movement of the central rod 110 into the hollow body member 100 in which it is housed. In this manner, the central rod 110, which grips the tubular spark plug tip 38, is withdrawn with tip 38. Thereafter, the second tool with the tubular tip attached thereto may be easily removed from the cylinder head and a new spark plug replaced or threaded into the spark plug socket of the cylinder head.

In some circumstances, the first tool need not be required and the process of removal of the hollow metal spark plug tip may be effected by utilizing only the second tool. Thus, if the porcelain element does not interfere with the utilization of the second tool, the second tool alone may be utilized.

Thus an object of the invention is to provide a tool kit for removal of broken spark plug elements located in a cylinder head wherein those elements include a hollow, tubular metal tip 38 of the plug with a portion of a porcelain insulator in the metal tip, said kit including a first tool for pushing the porcelain insulator portion of the spark plug into the hollow metal tip and a second tool for threadably connecting with the inside of the end of the hollow metal tip to thereby grip and subsequently effect extraction thereof from the cylinder head by substantially axial movement outward from the spark plug socket or opening.

Further to resolve additional repair issues that may arise when attempting to replace spark plugs in a cylinder head, a supplemental tool has been developed. Thus, it is an object, aspect and feature of the present invention to provide a supplemental tool which may be used independently or in combination with kits of the type depicted in U.S. Pat. No. 7,814,814 to expeditiously effect removal of the porcelain insulator as well as the wire connector 22, 24, 26 associated with a spark plug that is not serviceable yet remains fixed in position within a cylinder head.

Thus, a supplemental tool is provided to co-act in combination with a device or element of the type described as part of a combination with a tool similar to the second tool depicted in U.S. Pat. No. 7,814,814; namely, a hollow body with a cylindrical axial center passage. The supplemental tool includes an elongate generally cylindrical puller rod with a central body. An outer or first end of the rod includes a drive such as a hexagonal drive. The external surface of a central body section is threaded. The inner end of the puller rod comprises a wire connector contact grip construction. The grip construction is typically comprised of a series of generally coaxial, spaced, elastic segments or cantilever elements or sections which project axially from the grip end of the rod and define a passage or opening to an internal cavity formed by the sections. The cavity is designed and shaped to receive and grip the wire connector contact of a spark plug. Thus, the wire connector contact or the outer end of a spark plug may be inserted into the grip end of the supplemental tool by axially forcing the grip end to fit over and hook onto and grip the wire connector.

The supplemental tool may then be combined with a second tool comprising an annular, hollow, body element or a similar tool component. That is, the supplemental tool will fit within a hollow, cylindrical tubular body and the grip end thereof will extend from the body for engagement with the wire connector of a plug. The threaded supplemental tool central body or rod section may be subjected to axial movement or adjustment by cooperation with a threaded nut positioned on the body section and fitted flush with the outer end of the hollow body to thereby effect withdrawal of the supplemental tool axially from the hollow body member or tube. In this manner, the supplemental tool may be axially displaced by turning a nut. The supplemental tool is thus designed to effect gripping and axial movement and removal of the plug porcelain remnant and wire connection and/or other plug parts by engaging the wire connector rather than a firing tip 38.

Consequently, it is an object of the invention to provide an improved kit of tools which may be utilized for removal of spark plug elements that have been damaged or broken and remain in a cylinder head.

Another object of the invention is to provide a kit of tools which ensures that the tools will be axially aligned with the damaged spark plug element so that upon removal of the damaged portion of the spark plug from a cylinder head, the threads of the spark plug opening or socket in the cylinder head will not be damaged.

Another object of the invention is to provide a plug removal kit for broken spark plug elements in a cylinder head comprised of tools that are easy to use, and which can efficiently and effectively be utilized to remove broken spark plug elements in a very timely manner.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 12 is a side elevation of a supplemental tool;

FIG. 13 is an end view of the grip end of the supplemental tool of FIG. 12;

FIG. 14 is a cross sectional view of the grip end of FIG. 13 taken along the line 14-14;

FIG. 15 is an end view of the drive end of the supplemental tool of FIG. 12;

FIG. 16 is a plan view of the nut associated with the supplemental tool depicted in FIG. 12;

FIG. 18 is a sectional view illustrating the positioning of the section of the spark plug positioned in the cylinder head wherein the threaded portion of the plug may have been removed or has at least partially removed from the cylinder head by means of a socket or the like;

DETAILED DESCRIPTION OF EMBODIMENTS OF THE INVENTION

Figure 1:
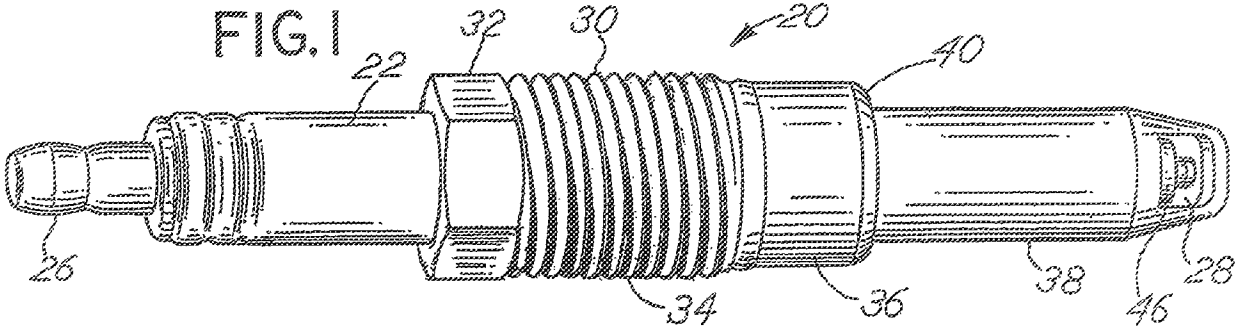
FIG. 1 PRIOR ART
FIG. 1 is an isometric view of a spark plug which is made for utilization in a cylinder head and which has a construction that may break into separate plug elements during removal from a cylinder head.
Figure 1A:
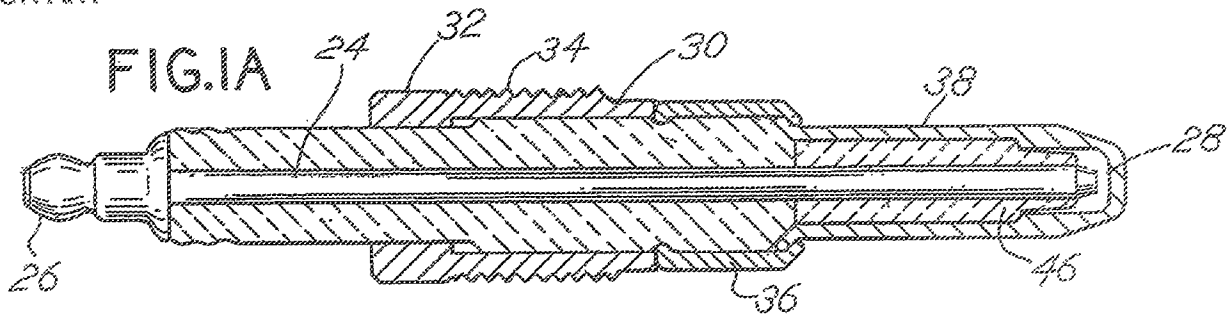
FIG. 1A PRIOR ART
FIG. 1A is a cross sectional view of the spark plug of FIG. 1.
Figure 2:
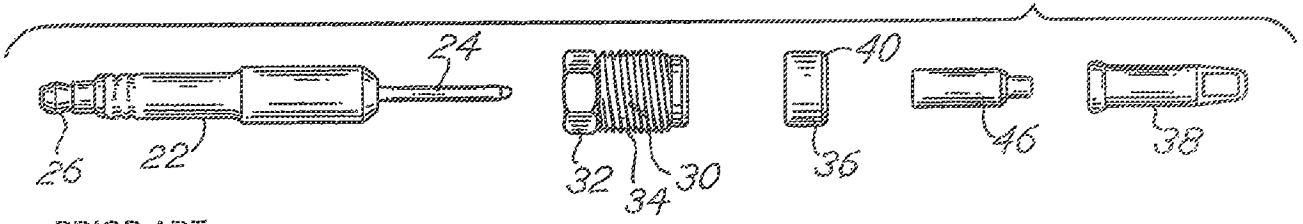
FIG. 2 PRIOR ART
FIG. 2 is an exploded side view of the spark plug of FIG. 1.
Figure 3:
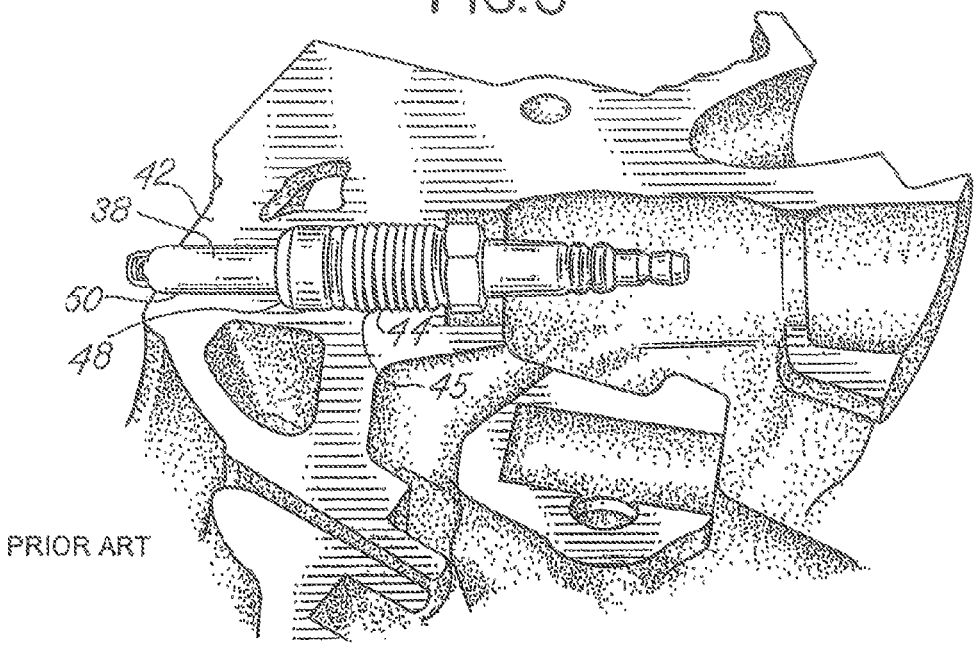
FIG. 3 is a cutaway isometric view of a cylinder head illustrating the position of a spark plug of the type depicted in FIG. 1.
Figure 4:
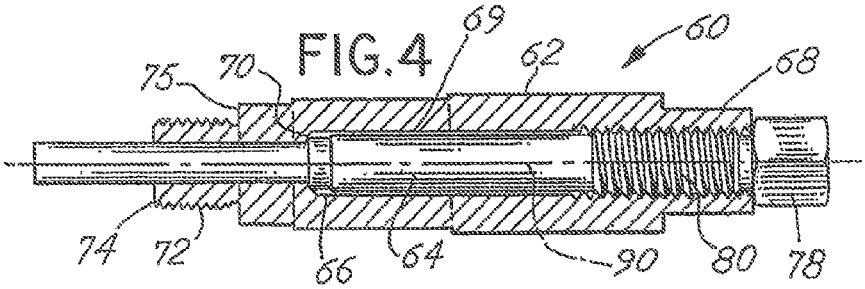
FIG. 4 is a cross sectional view of a first tool from the kit of the invention which is designed to position a broken ceramic or porcelain portion or element of the spark plug of FIGS. 1, 1A and 2 within the hollow, cylindrical tip of the spark plug.
Figure 5:
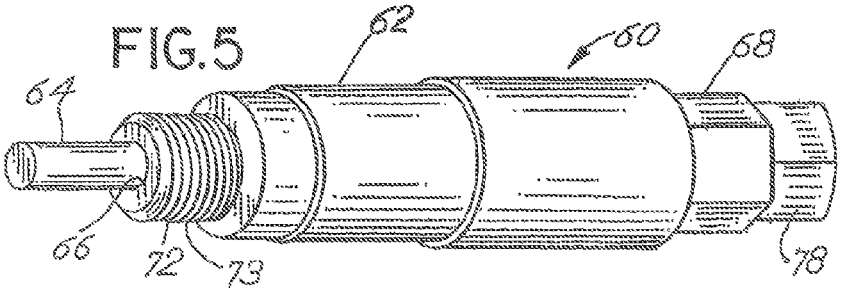
FIG. 5 is an isometric view of the tool of FIG. 4.
Figure 6:
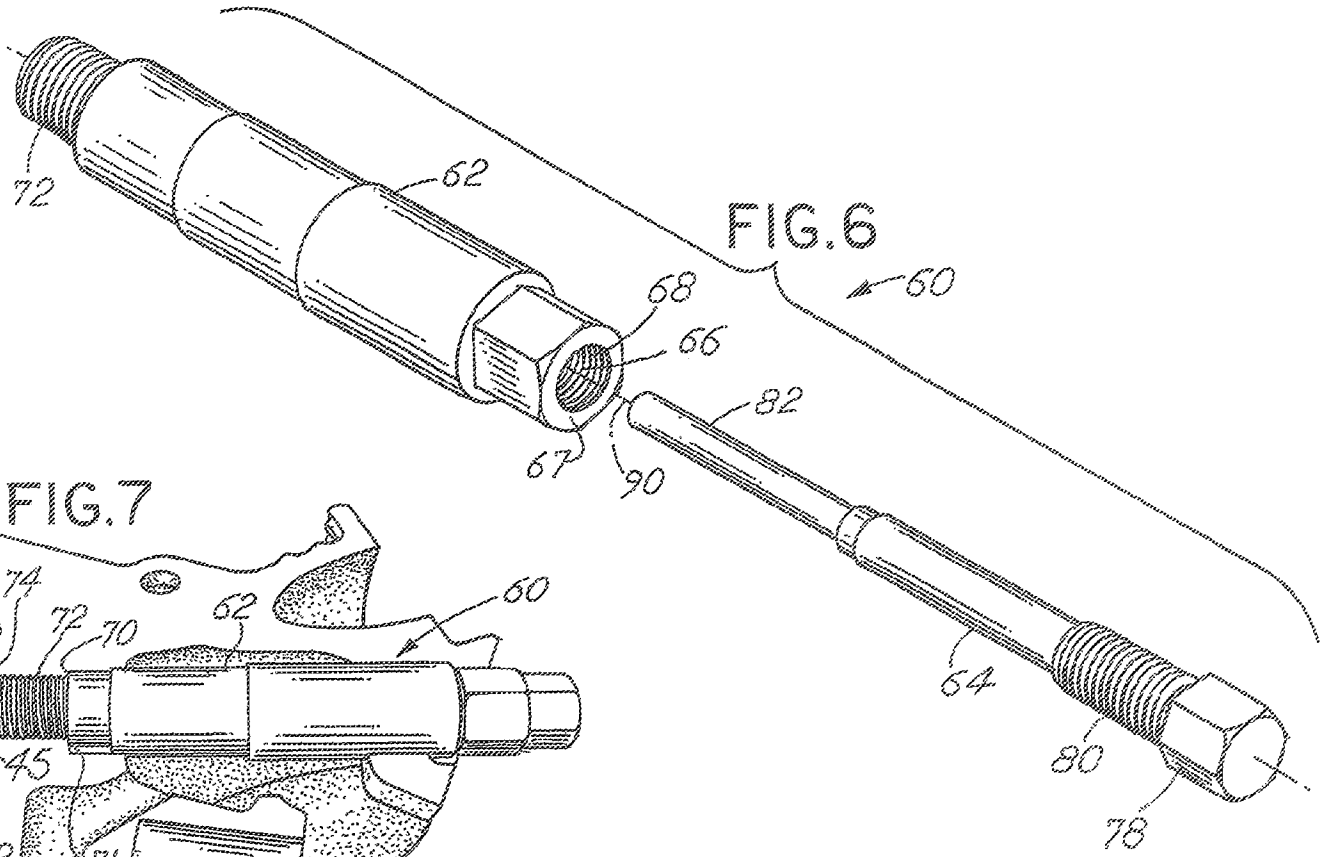
FIG. 6 is an exploded isometric view of the tool of FIG. 4.
Figure 7:
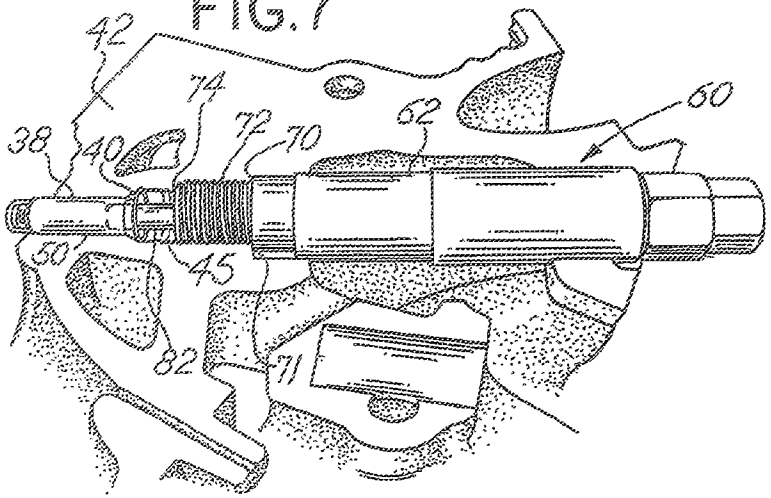
FIG. 7 illustrates the manner of positioning the tool of FIG. 4 within the cylinder head to engage and move the porcelain element into the spark plug tip.
Figure 8:
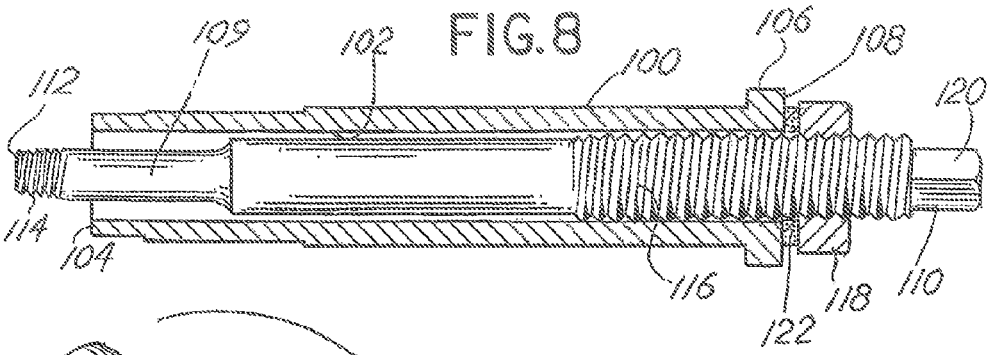
FIG. 8 is a cross-sectional view of the second tool of the kit which is used to remove the spark plug tip from the cylinder head.
Figure 10:
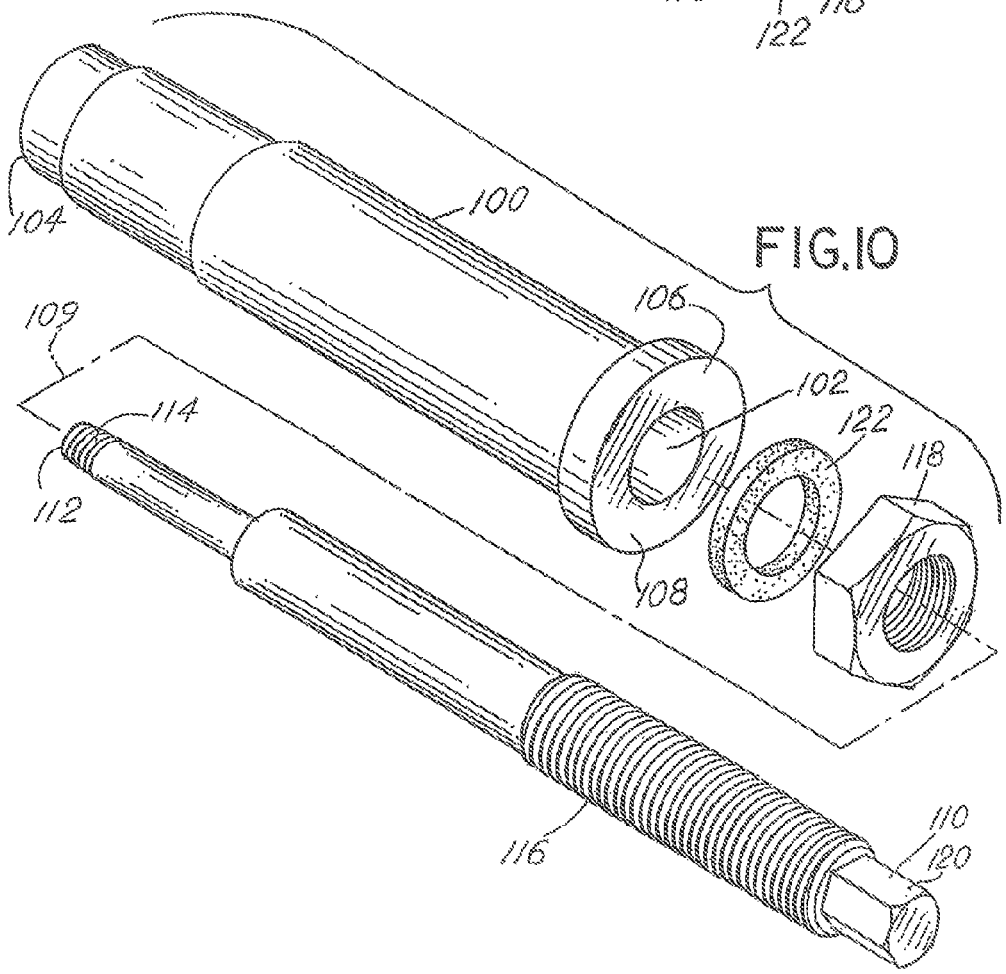
FIG. 10 is an exploded isometric view of the tool of FIG. 8.
Figure 9:
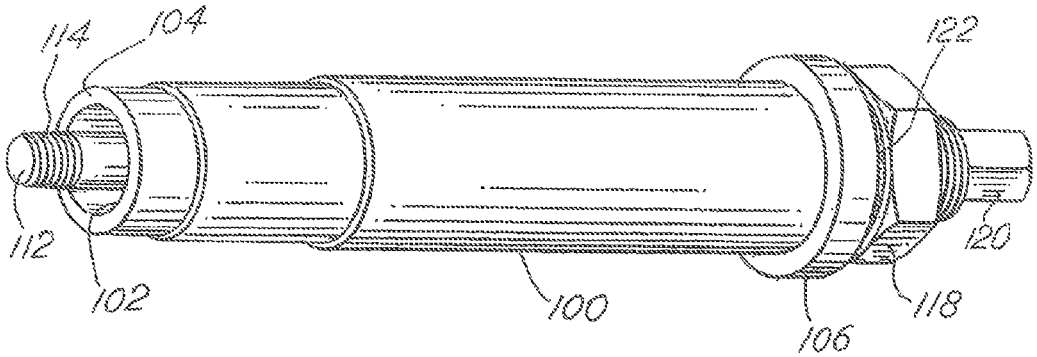
FIG. 9 is an isometric view of the tool of FIG. 8.
Figure 11:
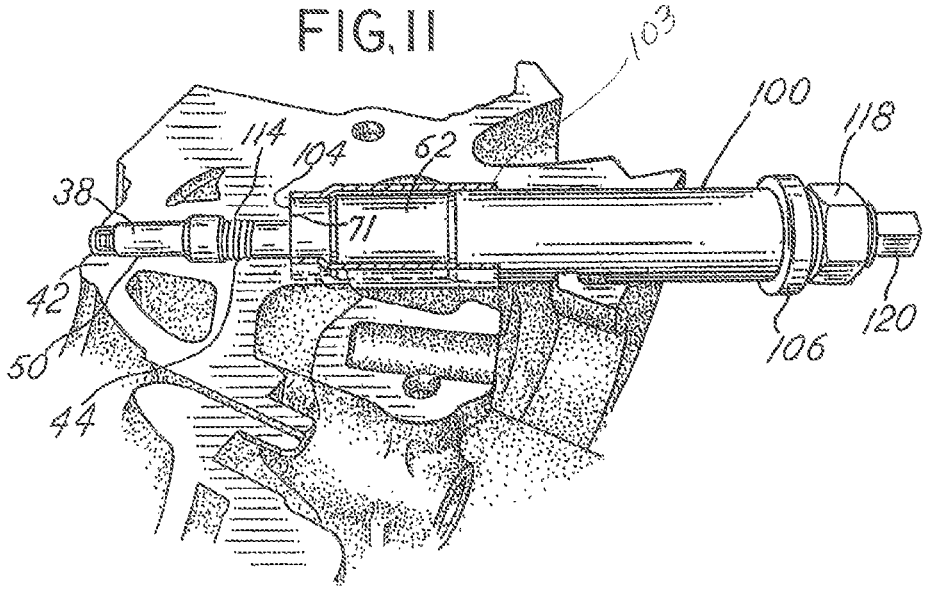
FIG. 11 is an isometric view illustrating the manner of use of the tool of FIG. 8.
Figure 17:
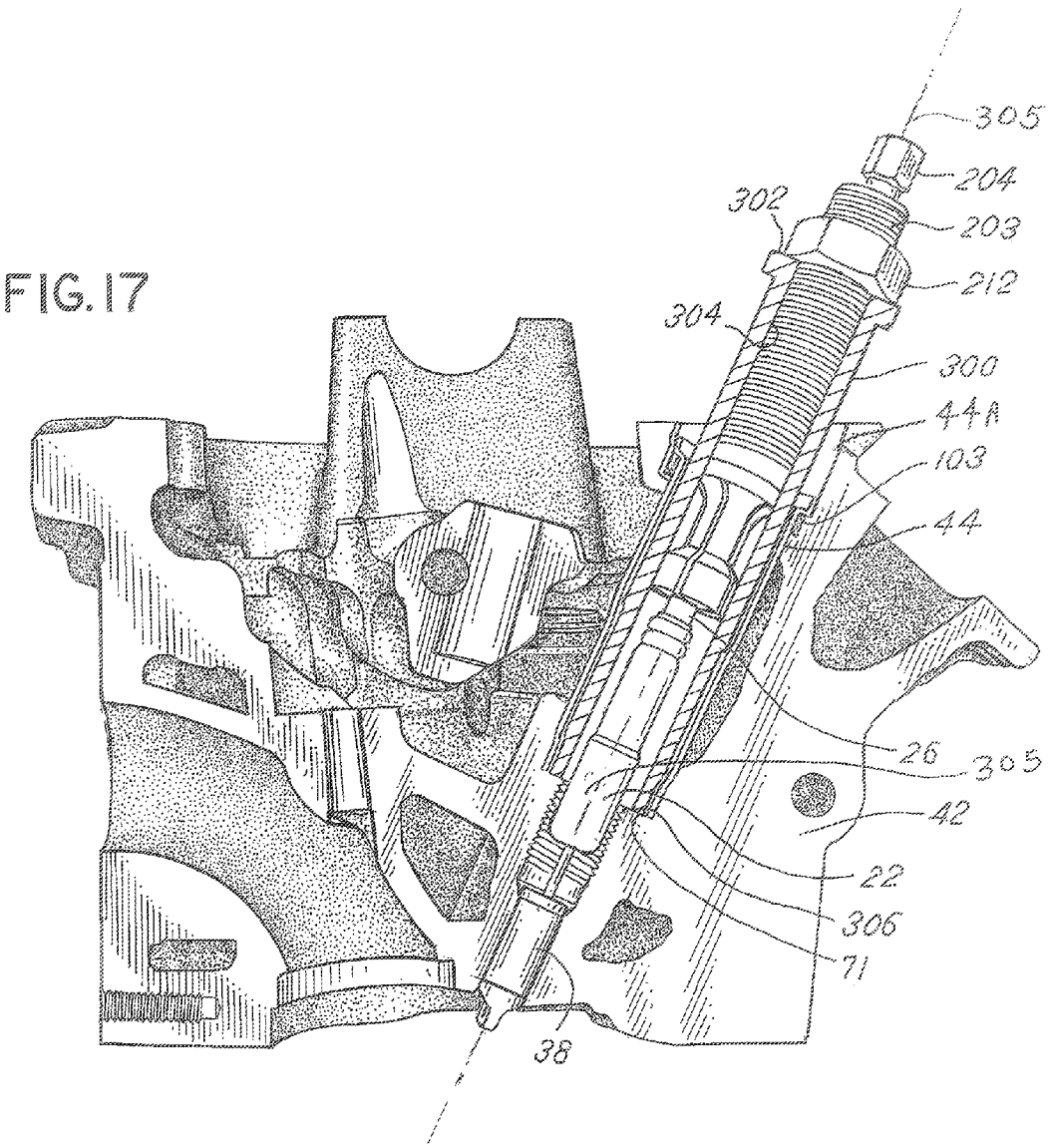
FIG. 17 is a sectional view depicting the supplemental tool of the invention in combination with an element depicting the engagement of the supplemental tool with the wire connector of a spark plug in an engine cylinder head.
Figure 18:
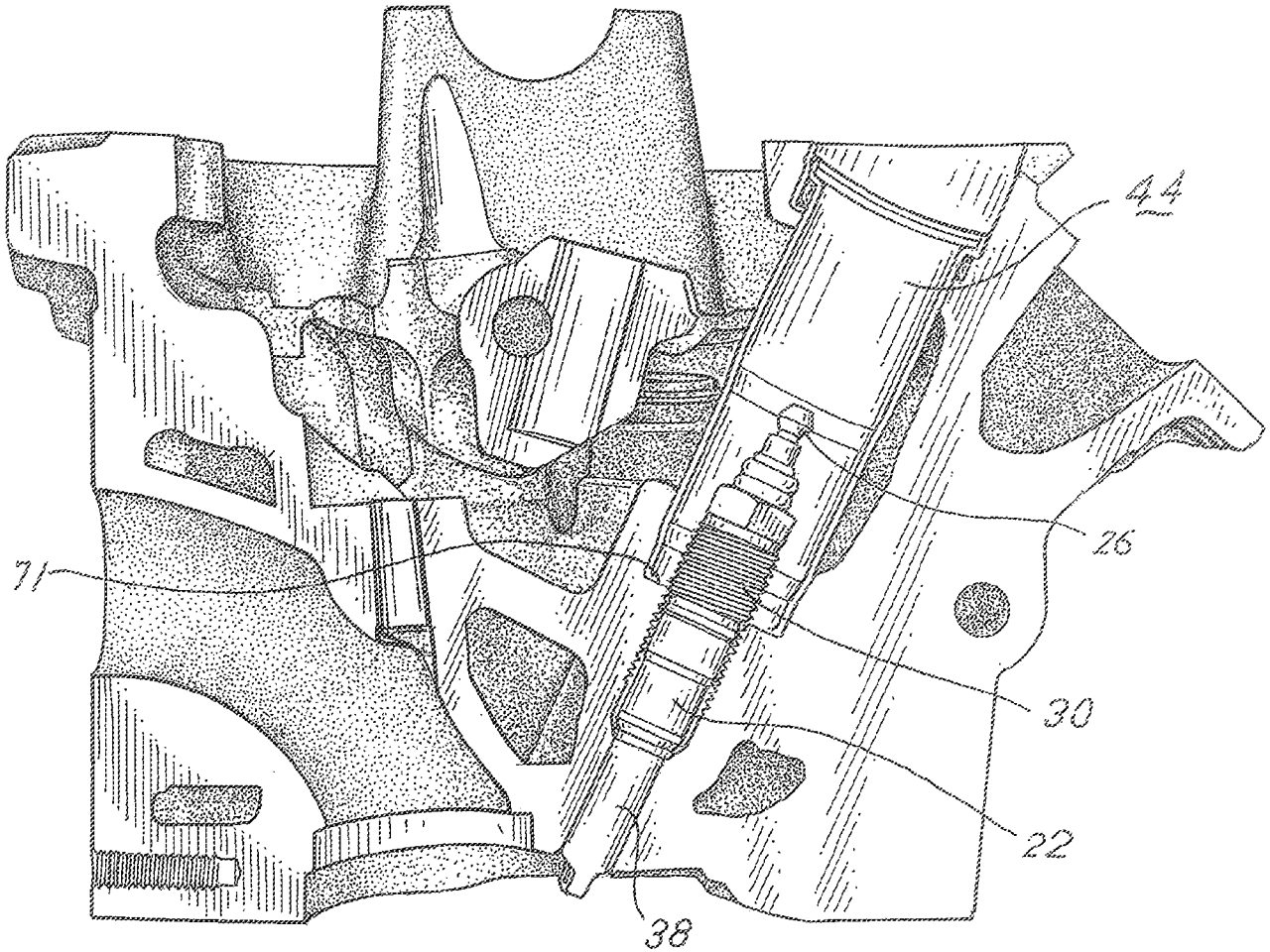
Figure 19:
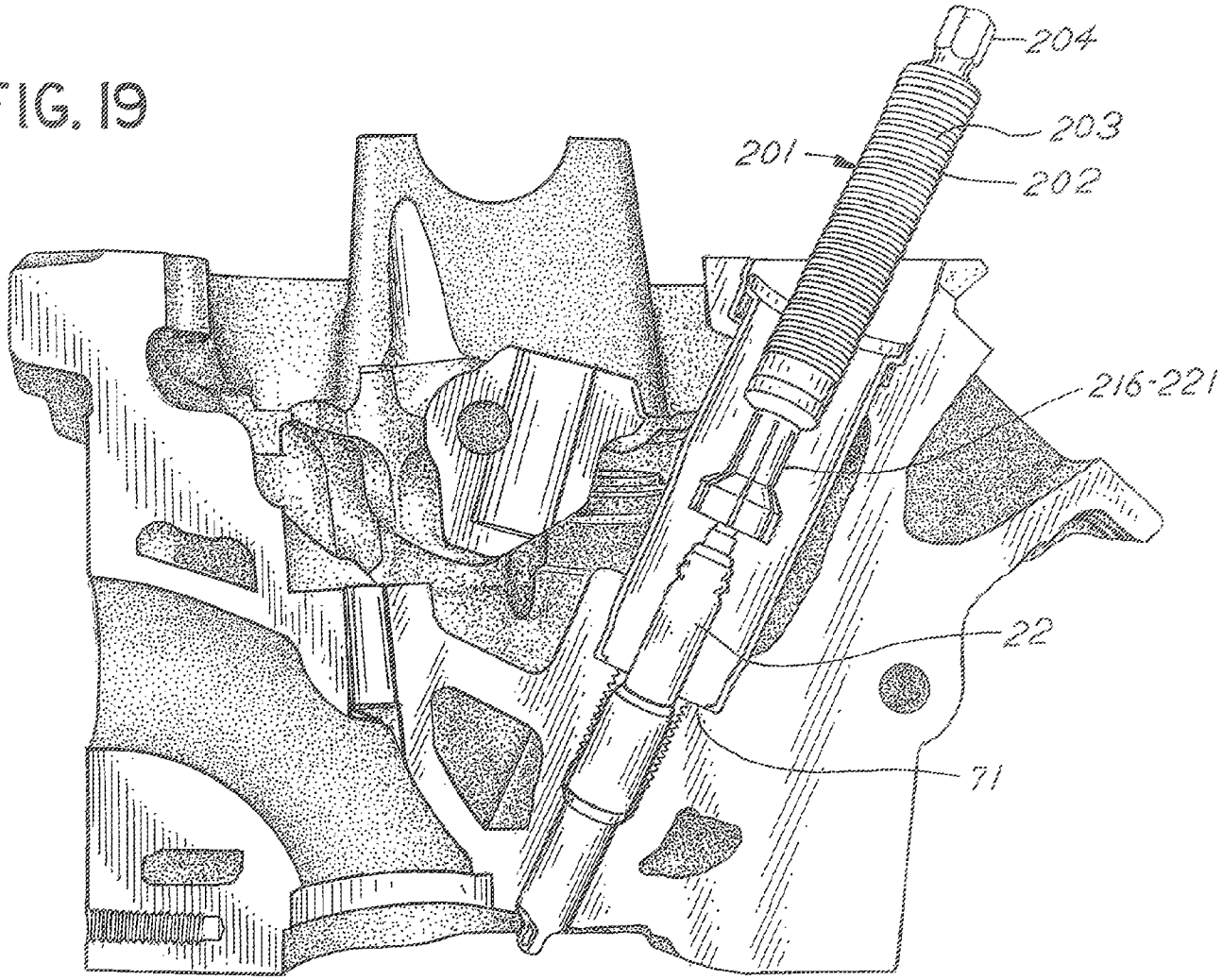
FIG. 19 is a diagrammatic view illustrating the positioning of the supplemental tool of the invention on the wire connector of a spark plug wherein the spark plug is absent the outer annular body of the plug.
Figure 20:
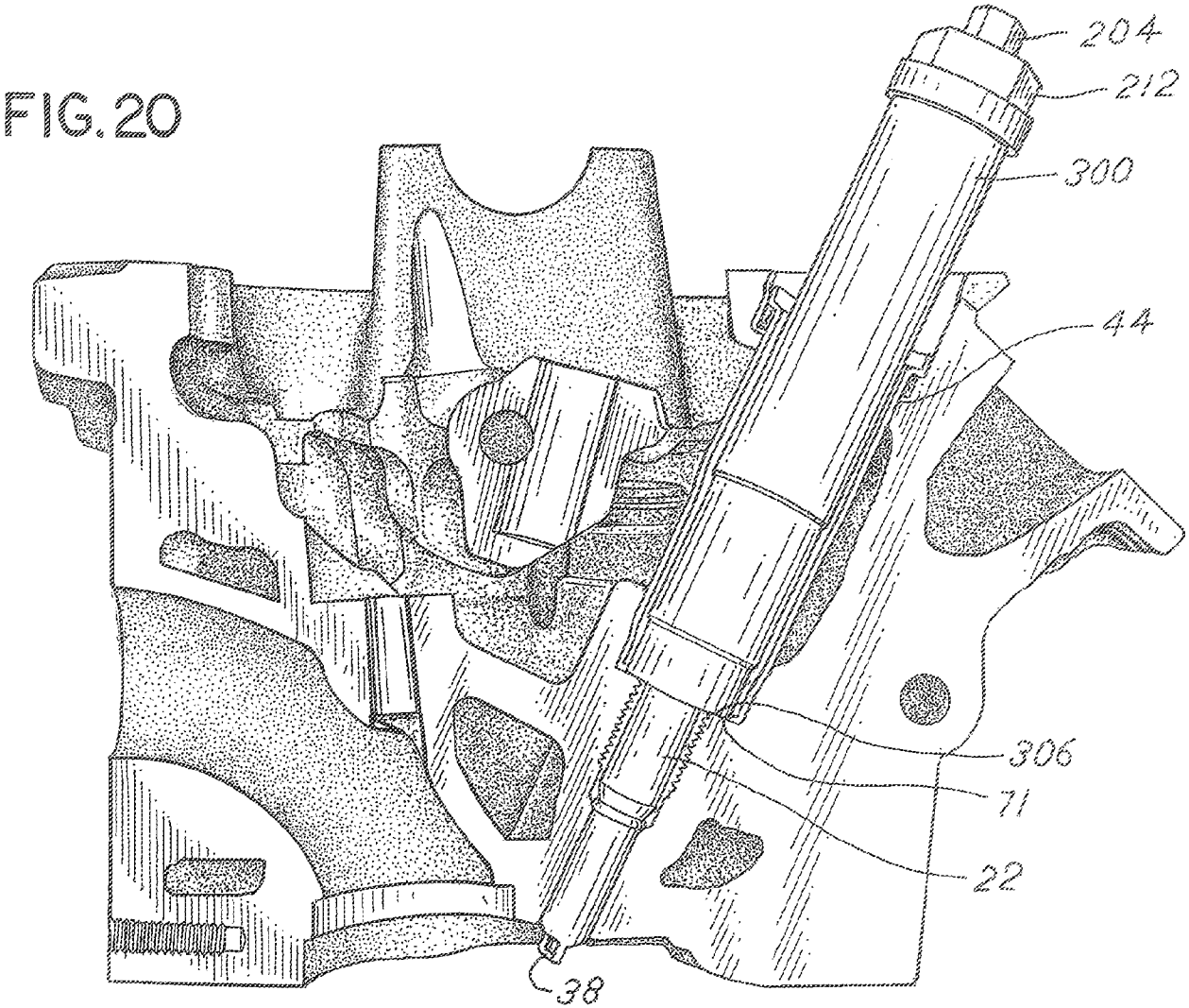
FIG. 20 is a sectional view illustrating the tubular member combined with the supplemental tool.

FIGS. 1-3 depict a spark plug construction of the type with which the kit of the invention may be utilized for removal or extraction of portions of a spark plug from a cylinder head. FIGS. 4-7 illustrate a first tool in the kit of the invention, including the manner of its use. FIGS. 8-11 relate to second tool of the kit of the invention including the manner of its use.

Referring initially to FIGS. 1-3, there is illustrated a typical spark plug construction with which the kit may be used. Subsequent to a description of the spark plug, an embodiment of the invention is described; namely, the tools comprising a portion of a kit and the methodology of the use of the tools in conjunction with a spark plug generally of the type depicted in FIGS. 1, 2 and 3.

The spark plug 20 is typically comprised of multiple component parts. The plug 20 includes a ceramic or porcelain insulator 22 with an axial conductive lead or member 24 shielded by the porcelain insulator 22 and having a distributor wire contact 26 at an outer end and a spark gap element 28 at the inner or opposite end or tip. The porcelain insulator 22 and attached axial conductor or wire element 24 are retained within an annular threaded outer metal body 30 with a hexagonal drive nut 32 at one end, and an adjacent threaded section 34. The annular outer body 30 is retained in position on the porcelain insulator 22 by means of a ring 36. The ring 36 fits over an annular or hollow, cylindrical, metal spark plug firing tip element 38 and retains that element 38. The ring 36 includes a land 40 that limits the insertion of the spark plug 20 into a cylinder head 42, and, more particularly, into a threaded spark plug bore or socket 44 of cylinder head 42. It is to be noted that the porcelain insulator 22 includes a porcelain tip section 46 which may be integral or separate and which fits into the spark plug firing tip 38. It is generally integral.

Insertion of a spark plug 20 of the type depicted into a cylinder head 42 is a very straightforward operation. Plug 20 is merely threaded into the plug socket 44 in head 42 and the land 40 limits the degree of insertion into the head 42 due to the fit with a compatible land 71 in the socket 44 of the head 42. Removal of the spark plug 20, however, is often accompanied by fracture of the porcelain insulator 22 and separation of a portion of the plug 20, e.g. the spark plug firing tip 38, and the porcelain insulator tip 46 from the remainder of the elements comprising the spark plug 20. Thus, there remains within the head 42, and more particularly, within the unthreaded section or socket 50 adjacent an engine cylinder of the bore 44, the elements comprised of the firing tip 38 and a section of the porcelain insulator tip 46. The described kit may be utilized to remove those broken elements from the unthreaded section 50 of bore 44 in the head 42.

Referring therefore to FIGS. 4-7, there is illustrated the first tool 60 of the kit, which is designed and utilized for positioning the porcelain insulator tip 46 fully within the spark plug firing tip 38 so that the second tool illustrated in FIGS. 8-11 may be utilized to effect removal of the firing tip 38 and porcelain insulator tip 46 from the engine block 42. The first tool 60 is comprised of two basic component parts, namely, a tubular pusher body 62, having a two part, axial pusher rod or screw 64 inserted therein. Thus the pusher body 62 includes an axial throughbore 66. The axial throughbore 66 is internally threaded at an outer end 68. The threaded section at the outer end 68 connects with a smooth bore section 69 that terminates with a land 70. The throughbore 66 continues axially and exits at the inner end 72 of the annular tubular body 62 which includes outer threads 73. That is, the inner end 72 of the tubular body 62 has a threaded cylindrical configuration with an end land 74 so that the tool 60 may be threadably inserted into the bore 44 in head 42 in place of the portion of the spark plug 20 previously removed therefrom. An annular flat surface 75 of body 62 seats on a land 71 of head 42 limiting insertion of the pusher tool or first tool 60 into the threaded bore 44.

The pusher rod 64 further includes a hex drive 78 at its outer end and a compatible threaded section 80 adjacent thereto, compatible with the threaded section 68 of the throughbore 66. The embodiment of the pusher rod 64 depicted includes a separate tip section 82 axially extending from rod 64 and projecting through the inner end 72 of the body 62 of the tool 60. Thus, upon rotation of the drive rod 64, by actuation of the drive 78, the rod 64 will be advanced axially to cause the tip 82 to move axially. The axial movement of rod 64 and thus tip section 82 is limited by hex header drive 78 which engages the outer top side, annular surface 67.

In use, the tool 60 is initially inserted and threaded into the bore 44 and surface 75 seats on land 71. The pusher rod 64 is then rotated in a manner which will engage the pusher tip section 82 against the porcelain insulator tip 46, driving that porcelain insulator tip 46 into the spark plug firing tip 38. Of course, the diameter and configuration of the pusher tip section 82 is such that it will fit into the interior of the spark plug firing tip 38. Typically the pusher tip section 82 has a diameter lesser than the internal diameter of the spark plug firing tip 38, but sized so as to engage the broken porcelain insulator tip 46 and drive that tip 46 into the spark plug firing tip 38. The head 78 engages surface 67 of body 62 and limits the degree of insertion of the pusher rod or screw 64. In the embodiment depicted, all of the elements comprising the pusher rod 64 as well as the annular body 62 are symmetrical about a longitudinal axis 90.

FIGS. 8-11 illustrate the construction and methodology of use of the second tool of the kit. Specifically, the second tool includes a hollow, annular tube or tubular member 100. The tubular member 100 includes a uniform diameter axial throughbore 102, an inner end land 104, defined by a land or stop surface which is annular, and an outer end 106. The tube 100 includes a circumferential annular flange at the outer end 106 having an annular flange surface or land 108 transverse to axis 109.

The inner end annular flange surface 104 is sized to fit against the land 71 of the head 42 and thus thereby limit the insertion of the hollow tube 100 into the head 42. The tube 100 is axially aligned in head 42 by a metal sleeve insert 103 in the axial passage of bore 44 joined to threaded section of bore 44. Thus the sizing, dimensions and configuration of the tube or hollow tubular 100 becomes somewhat important with respect to the utility of the second tool.

The second tool further includes a central or axial puller screw or rod 110. The puller screw or rod 110 includes an inner end 112 with threads 114 provided on the end 112. Further, the puller screw or rod 110 includes threads 116 at the outer end thereof, which have a pitch that will facilitate cooperation with a separate nut 118 to effect axial withdrawal of the rod 110 from the tube 100. The rod 110 of second tool further includes a hex drive 120 at its outer end adjacent to the threads 116. A nut 118 is threaded on threads 116 of rod 110 against a gasket 122 to facilitate smooth operation of the second tool.

Importantly, the threads 114 are of generally uniform pitch and formed on a frustoconical leading inner end 112 which has a lesser diameter at the extreme outer end of rod 110. The threads 114 are non-tapping or non-cutting threads to avoid formulation of shards that could fall into the cylinder of an engine. The threads 114 thus have a taper of their crests in the range of 6°±1° and a crest width no greater than about 0.008 inch. This enables the threads to grip the inside of the hollow tip 38 without undue mechanical force and without altering the configuration of the tip 38 by causing it to expand.

The second tool is operated in the following manner. Initially, the body 100 of the tool is inserted into the unthreaded section 44A of bore 44 of the head 42 and axially aligned therewith by virtue of a sleeve insert 103 in the head 42. The land 104 engages against the land 71 of bore 44 to limit the insertion of the tubular member 100. The puller screw or rod 110 is then inserted and rotated by actuation of the drive 120 to thread into the spark plug firing tip 38.

Subsequently, the nut 118 is rotated to engage the threads 116 and axially withdraw the puller screw or rod 110 with the attached spark plug firing tip 38 into the hollow tube 100. This results because of the threads 116 associated with the puller rod 110. For example, the threads 116 and the threads 118 associated with the nut 118 may, for example, be left handed threads. In other words, the pitch or orientation of the tapping threads 114 as well as the pitch of the threads 116 of the puller rod 110 may be the same. Other pitch arrangements may be utilized, however, to effect the series of steps and operation of the second tool in the kit.

In sum, therefore, in order to remove a broken spark plug firing tip 38 and any porcelain insulator portion 46 retained within that tip 38, the first tool is utilized to properly prepare the firing tip 38 and insulator portion 46 in a manner which will enable utilization of the second tool. The first tool effects pushing of the porcelain insulator tip 46 into the spark plug firing tip 38. The second tool then engages the interior of the tip and axially removes the spark plug firing tip 38 and anything retained within that tip 38 from the section 50 of socket or bore 44.

Referring to FIGS. 12-20 there is illustrated an embodiment of a supplemental tool 201 which may stand alone or be combined, for use in a kit in combination with previously described tools or other available similar tools. The supplemental tool 201 is comprised of an elongate generally cylindrical puller rod 200 which includes a threaded center or middle body section 202, a drive end 204 and a wire contact or connector grip end 206. The body section 202 as well the grip end 206 and drive end 204 lie on a straight, longitudinal axis 208 and are generally symmetrical about axis 208. The middle body section 202 is threaded and cooperative with a hexagonal nut 212 as depicted in FIGS. 17-20.

The grip end 206 includes a plurality of six (6) separate, equally sized and shaped elastic, cantilever, segments 216-221. The segments 216-221 are coaxial and define an outer, coaxial opening 224 which connects to a shaped cavity 226 that is connected to an axial tubular inner section 228. Thus, each of the segments, such as segment 216, includes an outer planar face 230 transverse to the axis 208. Each segment may be flexed elastically in a direction outwardly from axis 208 about the inner end 232 of each segment. The segments 216-221 are, in the embodiment depicted, of equal size, shape and elasticity and are typically fabricated from steel or a metal which is adequately flexible to enable the segments 216-221 to separate when pushed or inserted over a wire contact or connector 26. The cavity 226 is configured in a manner which will receive, guide, grip and retain the head of a wire connector 26. That is the opening 224 has a smaller cross section or area than the interior of the cavity 226 so that a wire connector 26 can be retained within the cavity 226 as the segments, such as segment 216, are elastically deformed to bend and fit over the wire connector 26.

The diameter of the grip end 206 and, in particular, the outer face or surface 230 of the grip end 206 is limited to the diameter of the threads 203 of the body mid-section 202. This feature enables the compressible segments, such as segment 216, to flex outwardly from the axis 208 yet be retained and restrained in position by the hollow interior surface of second tool body member 300. As shown in FIG. 14 the grip end 206 may be comprised of a separate component part 207 which is manufactured and combined by welding, soldering or the like with the remainder of the supplemental tool 201 construction.

The drive end 204 of the supplemental tool 201 is typically a hexagonal drive. It has a smaller diameter or transaxial dimension relative to the threaded opening in nut 212 so that the nut 212 may be fitted over the drive end 204 and engage the threads 203 of the mid-section 202 of tool 201.

FIGS. 17-20 illustrate the manner of use of the supplemental tool 201 in combination with a hollow tubular member 300. The tubular member 300 is capable of use in combination with the rod like tool element 110 tool depicted, for example, in FIG. 10. Thus, the body member 300 may be used in combination with the supplemental tool 201 depicted in FIGS. 12-16 and in addition to the puller rod or screw element 110 to effect connection to and removal of the connector wire or element 26 and other plug elements attached thereto by gripping the connector wire 26.

FIGS. 17-20 depict the sequence of steps or operation relating to the use of the supplemental tool 201 in combination with a hollow tubular member 300. The hollow tubular member 300 includes a planar outer land or face 302, a generally uniform axial throughbore 304 and a generally planar inner land end or face 306. Face 302 and face 306 are transverse to axis 305 of bore 304. The hollow tubular member 300 is sized to fit into the bore, socket, passage or opening 44 in the head of an engine designed to receive a spark plug. Thus, the hollow tubular member 300 may be inserted into the unthreaded section 44A of a bore 44 of the head 42 in general axial alignment with a broken plug which is positioned within that bore 44. The bottom face 306 thus ultimately engages against a land 71 of the bore 44 to limit the insertion of the tubular member 300.

Typically the supplemental tool 201 is first pushed over the wire contact 26. The segments 216-221 deflect outwardly upon engagement with the wire contact 26, then fit over contact 26 and grip contact 26. Then the sleeve or tube or tool 300 is slid over the tool 201. It is guided by the inside bore 304 going over the threaded section 202 of the tool 201. The outside diameter of tool 300, as it is pushed forward, is aligned with the diameter of the sleeve 44. Tool 300 is pushed until end 306 is seated against the land 71. The sequence of events is depicted stepwise in FIG. 18, then FIG. 19 and finally FIG. 20. Thus the tube 300 with the tool 201 positioned therein may be partially inserted into the bore 44. The tube 300 will be held in axial alignment with the plug wire contact 26 due to the substantially uniform major diameter of the threads of tool 201 and the diameter of the smooth cylindrical passage or bore 304 of tubular member 300. The nut 212 may then be threaded on body section 202 and rotated to withdraw the tool 201 and plug remnant from the tubular member 300, or the tool 201 and hollow tubular member 300 may be simultaneously withdrawn with the plug remnant.

Manipulating the various component elements; namely, the tool 201 as well as the hollow tubular member 300 along with the nut 212 thus may be utilized to effect ease of removal of the sparkplug remnant including engagement with and capture of the wire contact 26 in the cavity 226 due to elastic flexure of segments 216-221.

The puller tool 201 may be used in combination with a tubular member such as a tubular member 300 which itself may be used in combination with other rod type tools to engage other elements of a broken sparkplug as referenced herein. In addition, the supplemental tool 201 may be used in combination with various alternative designs of hollow tubes other than the hollow tubes specifically depicted in the drawings. Consequently, the supplemental tool has the capability of use with various types of plug removal kits containing various components designed to perform various functions.

It is possible to vary the construction and alter the features of the invention without departing from the spirit and scope thereof. For example, the positioning and pitch of the threads may be altered. The length and diameter of the various components may be altered in various ways while still maintaining the functionality described and providing the benefits of the invention. With the invention, the kit enables removal of broken spark plug elements from a cylinder head without adversely impacting or affecting the threads in the spark plug bore, and without causing binding or shearing or loss of spark plug component parts in the cylinder of the cylinder head. Thus, while it has been set forth an embodiment of the invention, it is understood that the invention is limited only by the following claims and equivalents thereof.

What is claimed is:

1. A tool kit for removal of a broken spark plug component from a cylinder head of an internal combustion engine comprising:

(a) a generally cylindrical, elongate puller rod with a straight, longitudinal axis, a first end section, a second opposite end section, a threaded center body section intermediate the first end section and second end section, said first end section including an external drive axially aligned with the threaded body section and said second end section, said second end section comprising a mechanical grip end mechanism, said grip end mechanism including a plurality of cantilever, elastic segments projecting axially from the rod to form a grip end opening and a cavity in the mechanical grip end, said cavity sized for receipt of a spark plug wire connector contact by elastic distortion of the segments and insertion of the wire connector contact through the opening into the cavity whereby the wire connector contact is retained by the elastic segments fitted onto the connector contact; and (b) a first hollow tubular member having a cylindrical outer surface, a first land at an inner end, said first land sized to limit the insertion of the tubular member into a spark plug bore in a cylinder head, said tubular member further including a uniform diameter axial throughbore and an outer end opposite the inner end forming a second land, said hollow tubular member throughbore sized for receipt and axially sliding movement in the axial throughbore of said puller rod positioned over the elastic segments of the puller rod inserted in the throughbore with the threaded body section at least in part and the mechanical grip end mechanism extending from the tubular member outer end whereby the puller rod may be positioned with the wire connector contact of the spark plug elastically received in the cavity formed by the segments and the tubular member seated in the spark plug bore and positioned to engage and surround the segments to retain the wire connector contact in the cavity whereby the puller rod may then be slidably operated by the external drive of the puller rod to axially remove the puller rod and connector contact from the seated tubular member.

2. The tool of claim 1 further including a threaded nut on the threaded body section capable of being seated on the outer end to axially move the puller rod.

3. The tool kit of claim 1 wherein said pull rod segments comprise at least three equally sized and shaped elastic segments, said segments radially spaced from the axis, axially aligned and compressible to maintain engagement with a spark plug wire connector.

4. The tool kit of claim 3 wherein said elastic segments are substantially identical.

5. The tool kit of claim 1 further including a second push and puller rod for separate use in combination with the tubular member, said second rod comprising:

an elongate straight rod member with a first push, tip end, a second opposite end section and an intermediate body section between the first push, tip end and the second end section, said body section including a threaded section intermediate the push, tip end and the second end section, said second end section including an external drive mechanism axially aligned with the threaded section, said second push and puller rod sized and configured to rotate and axially slide in said tubular member uniform throughbore to advance the inner push tip end to engage a porcelain element of a broken spark plug in a spark plug bore.

6. The kit of claim 5 wherein said second push and pull rod includes a threaded inner push end sized and shaped to fit into the interior of a spark plug firing tip.

7. The kit of claim 5 wherein the external drive mechanism of the second push and pull rod and the external drive of the puller rod are substantially identical.

8. The kit of claim 5 wherein the external drive mechanism and external drive comprise a threaded nut.

9. The kit of claim 8 wherein a washer is positioned intermediate the nut and the hollow tubular member.

10. The kit of claim 5 wherein the external drive mechanism and the external drive comprise an element selected from the group consisting of a threaded nut and a polygonal shaped drive end of an end section.

* * * * *